US008696495B2

(12) United States Patent
Galindo

(10) Patent No.: US 8,696,495 B2
(45) Date of Patent: Apr. 15, 2014

(54) METHOD FOR SELECTING A GOLF CLUB

(76) Inventor: Robert E. Galindo, Brownsville, TX (US)

( * ) Notice: Subject to any disclaimer, the term of this patent is extended or adjusted under 35 U.S.C. 154(b) by 113 days.

(21) Appl. No.: 12/819,227

(22) Filed: Jun. 21, 2010

(65) Prior Publication Data

US 2010/0331120 A1 Dec. 30, 2010

Related U.S. Application Data

(60) Provisional application No. 61/220,518, filed on Jun. 25, 2009.

(51) Int. Cl.
*A63B 53/00* (2006.01)

(52) U.S. Cl.
USPC ..... 473/409

(58) Field of Classification Search
USPC ..... 473/409
See application file for complete search history.

(56) References Cited

U.S. PATENT DOCUMENTS 6,328,660 B1 * 12/2001 Bunn, III ..... 473/257
2010/0022332 A1 * 1/2010 Van Horn ..... 473/409

* cited by examiner

*Primary Examiner* — Stephen L. Blau

(57) ABSTRACT

A method for selecting the optimum golf club is disclosed by utilizing formulas based on the golfer's ability, distance required and wind conditions. The selection is made by obtaining an average hitting distance with a golf club, determining the distance between the hitting spot and the target, calculating a club indicator, and correlating the club indicator to a particular club.

28 Claims, 1 Drawing Sheet

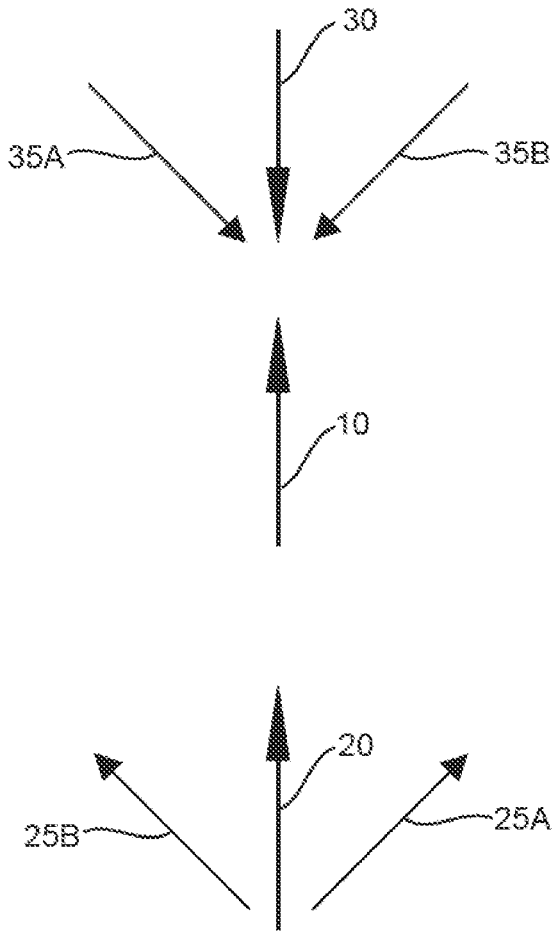
30
35A
35B
10
20
25B
25A

METHOD FOR SELECTING A GOLF CLUB

RELATED PRIORITY DATE APPLICATION

This application claims the benefit under 35 U.S.C. 119(e) of the U.S. provisional application No. 61/220,518 filed on Jun. 25, 2009.

TECHNICAL FIELD OF THE INVENTION

The present invention relates to game of golf, and, more particularly, to a method for selecting a golf club. Still more particularly, the present invention discloses a method for selecting the best golf club for a golfer based on his ability and wind conditions by utilizing formulas that determine the selection of the best club.

BACKGROUND OF THE INVENTION

The game of golf and the use of golf clubs of various types on the golf course are well known. The ability to obtain a low all around score in a golf game in part depends on the ability to select the optimum club for the shot at hand. The ability of a properly trained golfer who has good technique to make a good shot depends more heavily on proper club selection and not on the degree of force applied by the swing. The proper selection of the optimum club for a particular situation consistently leads to increased confidence in the swing and a lower all-around score. There are several club selection factors including the swing force or intensity, the range or distance to the target, wind direction and speed, slope (lie) at the ball, slope at the target, target elevation, and firmness of the ground at the target. Accurate club selection based on these factors and coupled with a good technique brings far fewer errors and consistently lower scores. Although golfers work hard and spend substantial amount of time practicing to improve and perfect their technique, their game of golf suffers because they are not proficient at evaluating the various factors in their selection of a golf club for a particular situation.

In the past, golfers have selected the golf club for a particular situation by relying upon guesswork, recalling prior selections and results obtained, and using paper and pencil or a calculator to determine the selection based on their prior experience and performance. Some disadvantages of those prior techniques is that they are inconvenient, unreliable, and time consuming.

According to the present invention, a method for selecting the optimum golf club by an individual golfer is disclosed which is based on his or her ability, skill level, technique and wind conditions. The method is convenient, reliable and fast.

These and other advantages of the present invention will become apparent from the following description and drawings.

SUMMARY OF THE INVENTION

A method for selecting the optimum golf club is disclosed by utilizing formulas based on the golfer's ability, distance required and wind conditions. The wind conditions affecting the method are absence of wind, direct negative and direct positive conditions, and diagonal negative and diagonal positive conditions.

First, the average distance is determined and measured in yards that the individual can hit a golf ball with a particular iron by hitting at least ten balls with a specific iron. Preferably, the average should be obtained under no wind conditions but, if wind is present, it should be obtained by hitting the balls towards a crosswind. Once the average distance is measured, a formula is used to calculate a unique number for the individual player referred to as the iron primer with zero wind effect by multiplying the number of the iron used to get the average yardage by 10 and adding the average yardage previously calculated.

Then, the recommended club indicator is calculated. The formula used depends on the wind conditions. When there is no wind the recommended club indicator is calculated by subtracting the distance between the current position of the golf ball and the center of the putting green or any particular target that the golfer is aiming to hit the ball to measured in yards from the iron primer with zero wind effect and dividing the resulting number by 10.

When the wind blows directly or diagonally against the desired ball direction, the recommended club indicator is calculated by adding the wind effect to the distance between the current position of the golf ball and the center of the putting green or any particular target that the golfer is aiming to hit the ball to measured in yards, subtracting that sum from the iron primer with zero wind effect and dividing the resulting number by 10. The wind effect used in this calculation is calculated by comparing the distance obtained when using the recommended club under zero wind effect and the distance obtained when using the same club by hitting the ball against the wind when the wind blows directly or diagonally against the desired ball direction.

When the wind blows directly or diagonally with the desired ball direction, the recommended club indicator is calculated by subtracting the wind effect from the distance between the current position of the golf ball and the center of the putting green or any particular target that the golfer is aiming to hit the ball to measured in yards, subtracting the resulting number from the iron primer with zero wind effect and dividing the resulting number by 10. The wind effect used in this calculation is calculated by comparing the distance obtained when using the recommended club under zero wind effect and the distance obtained when using the same club by hitting the ball with the wind when the wind blows directly or diagonally with the desired ball direction.

After the recommended club indicator is calculated, it is rounded up or down to the nearest whole number and it is correlated to the recommended club.

BRIEF DESCRIPTION OF THE DRAWINGS

For a detailed description of the preferred embodiments of the invention, reference will now be made to the accompanying drawings wherein:

FIG. 1 is a diagram showing the golf ball direction and the various wind directions that influence the selection of the optimum golf club in accordance with the present invention.

DESCRIPTION OF THE PREFERRED EMBODIMENT

According to the present invention, a method for selecting the optimum golf club by an individual golfer is disclosed. The method enables an individual golfer to select the best golf club in any location between the tee box and the green in a golf course based on his or her ability, skill level, technique and wind conditions. The method utilizes formulas that determine the selection of the best club.

One of the most important factors in applying the formula and determining the selection of the best golf club in accordance with the present invention is the direction of the wind relative to the desired direction of the golf ball. Referring now to FIG. 1, there is shown a desired ball direction 10 to advance the ball towards the green. One wind condition that affects the selection of the best golf club is when there is no wind. That condition is referred to herein as Zero Wind Effect.

Still referring to FIG. 1, there are also six more wind conditions that affect the selection of the best club represented by the general direction of the wind relative to ball direction 10. The first such condition is a positive wind direction 20 which is in the same direction as ball direction 10. Positive wind direction 20 is hereinafter sometimes referred to as Positive Wind Effect and is designated by "−PWE." The second condition is a positive diagonal wind direction 25A which is favorable for increasing the distance achieved when hitting the ball but would bias the ball to a direction towards the right of desired ball direction 10. The third condition is a positive diagonal wind direction 25B which is favorable for increasing the distance achieved when hitting the ball but would bias the ball to a direction towards the left of the desired ball direction 10. Positive diagonal wind directions 25A and 25B are hereinafter sometimes referred to as Positive Diagonal Wind Effect and are designated by "−PDWE." The fourth condition is a negative wind direction 30 which is directly opposite and on the same line as ball direction 10 and which would decrease the distance achieved when hitting the ball in the desired ball direction 10. Negative wind direction 30 is hereinafter sometimes referred to as Negative Wind Effect and is designated by "+NWE."

The fifth condition is a negative diagonal wind direction 35A which is favorable for decreasing the distance achieved when hitting the ball but would bias the ball to a direction towards the right of desired ball direction 10. The sixth condition is a negative diagonal wind direction 35B which is favorable for decreasing the distance achieved when hitting the ball but would bias the ball to a direction towards the left of the desired ball direction 10. Negative diagonal wind directions 35A and 35B are hereinafter sometimes referred to as Negative Diagonal Wind Effect and are designated by "+NDWE."

Determination of Average Yardage of Individual Golf Player

The first step for carrying out the method of the present invention for selecting the best club is determining the average distance measured in yards that the individual golf player can hit the ball with a particular iron. The average is calculated by the golfer hitting at least ten balls with a specific iron, measuring the distance achieved each time, adding up the achieved distances and diving the sum by the number of balls hit to obtain the average. While any iron could be used to determine such average except 8 or 9 Iron, it is preferred that a 7 Iron be used. Further, it is preferred that such average is obtained under Zero Wind Effect. If Zero Wind Effect is not present when the golfer hits the balls to obtain the average, the balls should be hit towards a crosswind. The average yardage determined by this process is referred to as "AY#I" where "#" is the number of the iron used to hit the balls to determine the average. For example, the term "AY7I" as used herein represents the average obtained by hitting at least 10 balls with a 7 Iron.

Calculation of Iron Primmer With Zero Wind Effect

The next step for carrying out the method of the present invention for selecting the best club is calculating the unique number for the individual player referred to as the Iron Primer with Zero Wind Effect (sometimes referred to as "IPO") by multiplying the number of the iron (#I) used to get the average yardage (AY#I) by 10 and adding the average yardage (AY#I). That calculation is represented by the following formula:

$$IPO=(\#I)(10)+AY\#I \qquad \text{FORMULA I}$$

It should be understood that even though this IPO is referred to as an Iron Primer with Zero Wind Effect, this IPO can be calculated by the same formula utilizing the average yardage (AY#I) obtained when Zero Wind Effect is not present and the average yardage (AY#I) is obtained by hitting at least ten balls into a crosswind as previously described in the step of determining the average yardage of the individual golf player.

Example 1

In this example the IPO is calculated when the subject golf player utilized a 7 Iron to hit at least 10 balls with Zero Wind Effect or into a crosswind and the average distance was 165 yards. Accordingly, #I is 7 and AY#I is 165 and the IPO is equal to 235 as calculated by Formula I:

$$IPO=(\#I)(10)+AY\#I=(7)(10)+165=235$$

Recommended Club Indicator

The term recommended club indicator (sometimes referred to as "RCI"), as used herein, shall mean a club selection indicator that is determined by a formula in accordance with the present invention. The calculated recommended club indicator ("RCI") is correlated to a specific club in accordance with a table that correlates the RCI with a particular recommend club as hereinafter described. The formula used to calculate the Recommended Club Indicator depends on whether there is Zero Wind Effect, Negative Wind Effect, Negative Diagonal Wind Effect, Positive Wind Effect, and Positive Diagonal Wind Effect. In addition to the terms previously defined, as used herein, the term "GBP" shall mean the distance measured in yards between the current position of the golf ball and the center of the putting green or any particular target that the golfer is aiming to hit the ball to. The GBP can be measured by devices that are well known in the golfing industry such as range finders enabled by global positioning satellite ("GPS") such as those marketed by SkyGolf, Bushnell, Callaway, or Garmin. Further, the term "WE," as used herein, shall mean the wind effect on the calculation when there is wind with Negative Wind Effect, Negative Diagonal Wind Effect, Positive Wind Effect or Positive Diagonal Wind Effect.

Calculation of Recommended Club Indicator with Zero Wind Effect

When there is no wind the RCI is calculated by subtracting the GBP from the Iron Primer with Zero Wind Effect (IPO) and dividing the resulting number by 10. The calculation is represented by the following formula:

$$(IPO-GBP)\div 10=RCI \qquad \text{FORMULA II}$$

Example 2

In this example the RCI is calculated when there is no wind and the IPO previously calculated is 235 and the measured GBP is 145 yards. The RCI is 9 as calculated by Formula II as follows:

$$(235-145)\div 10=9$$

Calculation of Recommended Club Indicator with Negative Wind Effect (+NWE) or with Negative Diagonal Wind Effect (+NDWE)

When there is a Negative Wind Effect (+NWE) or a Negative Diagonal Wind Effect (+NDWE) condition, the RCI is calculated by adding the wind (WE) effect to the GBP, subtracting the sum of the GBP and the WE from the Iron Primer with Zero Wind Effect (IPO) and dividing the resulting number by 10. The calculation is represented by the following formula:

$$[IPO-(GBP+WE)]\div 10=RCI \qquad \text{FORMULA III}$$

The Wind Effect is calculated by comparing the distance obtained when using the recommended club under Zero Wind Effect and the distance obtained when using the same club by hitting the ball against the wind in a Negative Wind Effect (+NWE) or a Negative Diagonal Wind Effect (+NDWE) condition. First, the golfer hits the ball with the recommended club under Zero Wind Effect and records the distance. Then, the golfer hits the ball with the same club against the wind in a Negative Wind Effect (+NWE) or a Negative Diagonal Wind Effect (+NDWE) and records the loss of distance in yards as compared to the distance obtained with the recommended club under Zero Wind Effect. The difference between the two distances which is a loss because the golfer is hitting against the wind is the wind effect (WE) which is placed in Formula III to be added to the GBP as shown. For example, if the golfer hits against the wind in a Negative Wind Affect, and records a loss of 10 yards using the iron recommended under Zero Wind Effect, the WE number is 10. Similarly, if the golfer hits against the wind in a Negative Diagonal Wind Affect, and records a loss of 5 yards using the iron recommended under Zero Wind Effect, the WE number is 5.

Example 3

In this example the RCI is calculated when there is Negative Wind Effect (+NWE) or a Negative Diagonal Wind Effect (+NDWE) condition, the IPO previously calculated is 235 and the measured GBP is 145 yards. The golfer hits a ball with the recommended club under Zero Wind Effect and a loss of 10 yards is recorded. The RCI is 8 calculated by Formula III as follows:

$$[235-(145+10)]\div 10=8$$

The inventor has also devised a formula to accurately convert the WE number (loss in distance in yards) obtained from hitting the ball as described above in a Negative Wind Effect (+NWE) to the WE number required in Formula III for Negative Diagonal Wind Effect (+NDWE) without hitting a ball to determine the loss and vice versa. More particularly, the inventor has discovered that the WE under Negative Wind Effect (+NWE) is equal to the WE under Negative Diagonal Wind Effect (+NDWE) multiplied by two. Alternatively stated, WE under Negative Diagonal Wind Effect (+NDWE) is equal to one half of the WE under Negative Wind Effect (+NWE). Accordingly, by way of example, if the WE under Negative Wind Effect (+NWE) is known by prior determination to be 10, then the WE under Negative Diagonal Wind Effect (+NDWE) is 5. Similarly, if the WE under Negative Diagonal Wind Effect (+NDWE) is known by prior determination to be 6, then the WE under Negative Wind Effect (+NWE) is 12.

Calculation of Recommended Club Indicator with Positive Wind Effect (−PWE) or with Positive Diagonal Wind Effect (−PDWE)

When there is a Positive Wind Effect (−PWE) or a Positive Diagonal Wind Effect (−PDWE) condition, the RCI is calculated by subtracting the wind (WE) from the GBP, subtracting the resulting number from the Iron Primer with Zero Wind Effect (IPO) and dividing the resulting number by 10. The calculation is represented by the following formula:

$$[IPO-(GBP-WE)]\div 10=RCI \qquad \text{FORMULA IV}$$

The Wind effect is calculated by comparing the distance obtained when using the recommended club under Zero Wind Effect and the distance obtained when using the same club by hitting the ball with the wind in a Positive Wind Effect (−PWE) or a Positive Diagonal Wind Effect (−PDWE) condition. First, the golfer hits the ball with the recommended club under Zero Wind Effect and records the distance. Then, the golfer hits the ball with the same club with the wind in a Positive Wind Effect (−PWE) or a Positive Diagonal Wind Effect (−PDWE) and records the gain of distance in yards as compared to the distance obtained with the recommended club under Zero Wind Effect. The difference between the two distances which is a gain because the golfer is hitting with the wind is the wind effect (WE) which is placed in Formula III to be subtracted from the GBP as shown. For example, if the golfer hits the ball with the wind in a Positive Wind Affect, and records a gain of 10 yards using the iron recommended under Zero Wind Effect, the WE number is 10. Similarly, if the golfer hits the ball with the wind in a Positive Diagonal Wind Affect, and records a gain of 5 yards using the iron recommended under Zero Wind Effect, the WE number is 5.

Example 4

In this example the RCI is calculated when there is Positive Wind Effect (−PWE) or a Positive Diagonal Wind Effect (−PDWE) condition, the IPO previously calculated is 235 and the measured GBP is 145 yards. The golfer hits a ball with the recommended club under Zero Wind Effect and a gain of 10 yards is recorded. The RCI is 10, as calculated by Formula IV as follows:

$$[235-(145-10)]\div 10=10$$

The inventor has also devised a formula to accurately convert the WE number (gain in distance in yards) obtained from hitting the ball as described above in a Positive Wind Effect (−PWE) to the WE number required in Formula IV for Positive Diagonal Wind Effect (−PDWE) without hitting a ball to determine the loss, and vice versa. More particularly, the inventor has discovered that the WE under Positive Wind Effect (−PWE) is equal to the WE under Positive Diagonal Wind Effect (−PDWE) multiplied by two. Alternatively stated, WE under Positive Diagonal Wind Effect (−PDWE) is equal to one half of the WE under Positive Wind Effect (−PWE). Accordingly, by way of example, if the WE under Positive Wind Effect (−PWE) is known by prior determination to be 14, then the WE under Positive Diagonal Wind Effect (−PDWE) is 7. Similarly, if the WE under Positive Diagonal Wind Effect (−PDWE) is known by prior determination to be 5, then the WE under Positive Wind Effect (−PWE) is 10.

If the Calculated Club Indicator is zero or less or the recommendation is for a club that the golfer does not feel comfortable with or does not have it available in the golf bag, a recalculation may be carried out for a shorter lay-up shot.

The formulas above are used to calculate the Recommended Club Indicator. Unless the calculated RCI is less than 2, the calculated RCI is rounded up or down to the nearest whole number. For example, if the calculated to the RCI is between 10 and 10.5, it is rounded down to 10. If the calculated RCI is larger than 10.5, it is rounded up to 11. If the calculated RCI is less than 2, the actual calculated number is used without rounding it up or down.

After the RCI is calculated, the recommended club is determined by the following table (Table I) wherein the first column represent the calculate RCI rounded up or down and the right column represent the corresponding Iron, Wood or Comparable Club. Each row represents the calculated RCI and its corresponding club.

TABLE I

| CALCULATED CLUB INDICATOR (RCI) | RECOMMENDED CLUB |
|---|---|
| 0 or Less | Driver |
| 1 to 1.4 | 1 Iron or 3 Fairway Wood |
| 1.5 to 1.9 | 1 Iron or 4 Fairway Wood |
| 2 | 2 Iron or 5 Fairway Wood |
| 3 | 3 Iron or 7 Utility Wood |
| 4 | 4 Iron or 9 Utility Wood |
| 5 | 5 Iron |
| 6 | 6 Iron |
| 7 | 7 Iron |
| 8 | 8 Iron |
| 9 to 10 | 9 Iron |
| 11 to 12 | Pitching Wedge |
| 12 to 13 | Gap Wedge |
| 14 to 15 | Sand Wedge |
| 16 to 17 | Lob Wedge |

The calculations and correlations above can be carried out manually or by a portable electronic device which can use well known electronic techniques preset with built in programs to carry out the above calculations and to determine the appropriate club with speed.

Table 1 includes basic golf clubs and the correlation relates to those clubs. Currently, however, there is available a larger selection of comparable golf clubs. The table can be expanded to include hybrids, Fairway Woods and Utility Woods not listed above with an appropriate correlation to a Calculated Club Indicator (RCI).

The following examples further illustrate the invention but are not to be construed as limitations on the scope of the invention contemplated herein.

Example 5

In this example the RCI is calculated and the recommended club is determined when there is Negative Wind Effect (+NWE) condition, the IPO previously calculated is 235, the measured GBP is 165 yards and the measured WE is +10 yards. Accordingly, the RCI is 6, as calculated by Formula III as follows:

$$[235-(165+10)]\div 10=6$$

Referring now to Table 1, when the RCI is 6, the recommended club is a 6 Iron.

Example 6

In this example the RCI is calculated and the Recommended Club is determined when there is Positive Wind Effect (−PWE) condition, the IPO previously calculated is 235, the measured GBP is 140 yards and the measured WE is −10 yards. Accordingly, the RCI is 10.5, as calculated by Formula IV as follows:

$$[235-(140-10)\div 10=105$$

The RCI is rounded down to 10. Referring now to Table 1, when the RCI is 10, the recommended club is a 9 Iron.

Example 7

In this example the RCI is calculated and the recommended club is determined when there is Zero Wind Effect condition (WE=0), the IPO previously calculated is 235, and the measured GBP is 180 yards. Accordingly, the RCI is 5.5, as calculated by Formula II as follows:

$$(235-180)\div 10=5.$$

The RCI is rounded down to 5. Referring now to Table 1, when the RCI is 5, the recommended club is a 5 Iron.

The method disclosed by the present invention enables one to choose the best club for a particular situation. The reliability of the method, however may be affected when the golf club irons are not a matched set, the golf club woods or metal woods are not a matched set, when the ball is not played from the fair way, when the ball is played from an uneven lie, when the clubs are damaged or are substandard, when the weather conditions are inconsistent and the player is not consistent in striking the ball.

While preferred embodiments of the invention have been shown and described, modifications thereof can be made by one skilled in the art without departing from the spirit of the invention.

What is claimed is:

1. A method for improving a golfer's performance by assisting the golfer to select the most suitable golf club to be used by the golfer on a particular day and in a particular hitting spot aiming at a particular target from the hitting spot on a golf course during a game of golf, comprising the steps of:

the golfer hitting a golf ball with a golf club and obtaining an average hitting distance traveled by the golf ball hit with the golf club;

determining the distance between the hitting spot and the target by using a device;

calculating a club indicator;

correlating the club indicator to a particular golf club; and using the particular golf club to hit the golf ball from the hitting spot to the particular target.

2. The method according to claim 1 wherein the step of obtaining an average hitting distance with the golf club includes the step of hitting the golf ball at least ten times.

3. The method according to claim 1 wherein the step of obtaining an average hitting distance with the golf club includes the steps of hitting several golf balls with a specific club, measuring the distance achieved each time, adding up the achieved distances and diving the sum by the number of balls hit to obtain the average.

4. The method according to claim 1 wherein the golf club is an iron club.

5. The method according to claim 4 further including the step of multiplying the number of the iron used to get the average distance by a certain number and adding the average hitting distance to obtain an iron primer number.

6. The method according to claim 5 wherein the average distance is measured in yards and the certain number is 10.

7. The method according to claim 5 wherein the wind condition is no wind condition and the club indicator is calculated by subtracting the distance between the hitting spot and the target from the iron primer number and dividing the resulting number by 10.

8. The method according to claim 1 wherein the golf club is an iron club other than an 8 iron or a 9 iron club.

9. The method according to claim 8 wherein the iron club is a 7 iron.

10. The method according to claim 1 wherein the step of obtaining an average hitting distance with the golf club includes the step of hitting the golf ball under no wind conditions.

11. The method according to claim 1 wherein the step of obtaining an average hitting distance with the golf club includes the step of hitting the golf ball ender crosswind conditions.

12. The method according to claim 1 wherein the average hitting distance is measured in yards.

13. The method according to claim 1 wherein the step of calculating a club indicator is carried out under a certain wind condition.

14. The method according to claim 13 wherein the wind condition is a no wind condition.

15. The method according to claim 13 wherein the wind condition is a positive wind direction which is in the same direction as the desired ball direction.

16. The method according to claim 13 wherein the wind condition is a positive diagonal wind direction which is favorable for increasing the distance achieved when hitting the ball but would bias the ball to a direction towards the right or the left of the desired ball direction.

17. The method according to claim 13 wherein the wind condition is a negative wind which is in the direction which is directly opposite to the desired ball direction.

18. The method according to claim 13 wherein the wind condition is a negative diagonal wind direction which is favorable for decreasing the distance achieved when hitting the ball but would bias the ball to a direction towards the right or the left of the desired ball direction.

19. A method for selecting the best golf club to be used at a hitting spot for a specific target by a golfer, comprising the steps of:

the golfer hitting a golf ball with an iron golf club and obtaining an average hitting distance traveled by the golf ball hit with the iron golf club;

multiplying the number of the iron used to get the average distance by a certain number and adding the average hitting distance to obtain an iron primer number.

determining the distance between the hitting spot and the target with a measuring device;

establishing a wind effect value;

calculating a club indicator for a wind condition that affects the distance traveled by a golf ball; and correlating the club indicator to a particular golf club to select the best golf club.

20. The method according to claim 19 wherein the average hitting distance is measured in yards and the certain number is 10.

21. The method according to claim 19 wherein the wind condition is a negative wind which is in the direction which is directly opposite to the desired ball direction or a negative diagonal wind which is favorable for decreasing the distance achieved when hitting the ball but would bias the ball to a direction towards the right or the left of the desired ball direction.

22. The method according to claim 21 wherein the wind effect value is the difference between the distance obtained when a golf ball is hit with a recommended golf club under no wind conditions and the distance obtained when the ball is hit with the same club against a negative wind or a negative diagonal wind.

23. The method according to claim 22 wherein the club indicator is calculated by adding the wind effect value to the distance between the hitting spot and the target subtracting the resulting sum from the iron primer number and dividing the resulting number by 10.

24. The method according to claim 21 wherein the wind effect value for a negative diagonal wind is one half of the wind effect value for a negative wind direction which is directly opposite to the desired ball direction.

25. The method according to claim 19 wherein the wind condition is a positive wind direction which is in the same direction as the desired ball direction or a positive diagonal wind which is favorable for increasing the distance achieved when hitting the ball but would bias the ball to a direction towards the right or the left of the desired ball direction.

26. The method according to claim 25 wherein the wind effect value is the difference between the distance obtained when a golf ball is hit with a recommended golf club under no wind conditions and the distance obtained when the ball is hit with the same club with a positive wind or a positive diagonal wind.

27. The method according to claim 26 wherein the club indicator is calculated by subtracting the wind effect value from the distance between the hitting spot and the target, subtracting the resulting first number from the iron primer number and dividing the resulting second number by 10.

28. The method according to claim 25 wherein the wind effect value for a positive diagonal wind is one half of the wind effect value for a positive wind direction which is in the same direction as the desired ball direction.

* * * * *